US006616325B1

(12) United States Patent
Brown

(10) Patent No.: US 6,616,325 B1
(45) Date of Patent: Sep. 9, 2003

(54) MIXING APPARATUS HAVING A COAXIAL CURVED SURFACE PRODUCING A PUMPING ACTION CONDUCIVE TO MIXING FLUIDS AND SOLIDS

(75) Inventor: Christopher John Brown, Glossop (GB)

(73) Assignee: Tecexec Limited, Glossop (GB)

( * ) Notice: Subject to any disclaimer, the term of this patent is extended or adjusted under 35 U.S.C. 154(b) by 0 days.

(21) Appl. No.: 09/937,648

(22) PCT Filed: Apr. 3, 2000

(86) PCT No.: PCT/GB00/01144

§ 371 (c)(1),
(2), (4) Date: Jan. 3, 2002

(87) PCT Pub. No.: WO00/59617

PCT Pub. Date: Oct. 12, 2000

(30) Foreign Application Priority Data

Apr. 1, 1999 (GB) ..... 9907502

(51) Int. Cl.[7] ..... B01F 5/12
(52) U.S. Cl. ..... 366/262; 366/302
(58) Field of Search ..... 366/262, 302, 366/305; 417/250, 252; 418/15, 260

(56) References Cited

U.S. PATENT DOCUMENTS 2,280,271 A * 4/1942 Sullivan
2,280,272 A * 4/1942 Sullivan
3,194,540 A * 7/1965 Hager
4,189,291 A * 2/1980 Longhi
5,387,386 A * 2/1995 Kirjavainen
5,538,343 A * 7/1996 Tynan
6,086,239 A * 7/2000 Jarvenkyla et al.
6,217,206 B1 * 4/2001 Kirjavainen et al.
6,354,729 B1 * 3/2002 Brown

FOREIGN PATENT DOCUMENTS

| | | | |
|---|---|---|---|
| DE | 19539136 | * 4/1996 | |
| DE | 19516578 | * 5/1996 | |
| GB | 2100138 | * 12/1982 | |
| GB | 2308076 | * 6/1997 | |
| SU | 606609 | * 4/1978 | ..... 366/262 |

OTHER PUBLICATIONS

Patent Abstracts of Japan, vol. 006, No. 080 (M–129), May 19, 1982 & JP 57 018488 A (Nippon Jiirootaa KK) Jan. 30, 1982.*

* cited by examiner

*Primary Examiner*—Charles E. Cooley
(74) *Attorney, Agent, or Firm*—Woodard, Emhardt, Moriarty, McNett & Henry LLP

(57) ABSTRACT

Apparatus for mixing a material contained in a vessel comprises one or more flow channels and at least one pair of first and second members which are coaxially mounted one within the other about an axis of rotation such that their facing surfaces curve around the axis defining a chamber therebetween. At least one of the first and second members having a non-circular curvature, the first and second members being rotatable relative to one another about the axis to thereby produce a pumping force to force material through said flow channels. The radially outermost of said first and second members moves to a wall of the vessel relative to stress and displace material present between the mixing apparatus and the wall of the vessel.

16 Claims, 3 Drawing Sheets

MIXING APPARATUS HAVING A COAXIAL CURVED SURFACE PRODUCING A PUMPING ACTION CONDUCIVE TO MIXING FLUIDS AND SOLIDS

The present invention relates to a mixing apparatus.

The operation of mixing is generally understood to comprise two distinct actions; dispersive mixing and distributive mixing. In dispersive mixing the individual parts of the materials being mixed, whether solid or fluid, have their respective geometries altered by means of applied stresses. This usually takes the form of reducing the average size of individual parts while increasing their numbers. In distributive mixing the individual parts of the materials, whether solid or fluid, are blended together in order to obtain a spatial uniformity in the distribution of the various material parts with respect to one another. A good mixing operation thus usually requires both dispersive and distributive mixing actions to occur.

Distributive mixing is primarily a function of the geometry of the mixing apparatus and known mixers typically fall into two general types providing either random or structured distributive mixing. Random distributive mixers achieve mixing by randomly agitating the materials and include known mixers such as tumbleblenders and ribbon-blenders. Structured-distributive mixers on the other hand achieve mixing by systematically repeating a geometrically controlled sequence of dividing, reorienting and rejoining the materials and include static mixers and cavity transfer mixers.

In contrast, dispersive mixing is primarily a function of forces, pressures, stresses and stains applied to the materials. In general, the size reduction of materials that is required in dispersive mixing is achieved by applying stresses to the materials. These applied stresses usually take the form of compressive, tensile or shear stresses. For mixing fluid materials the predominant method of stressing has been by means of applying shear, as this can readily be achieved by utilizing the drag forces that exist within a fluid bounded by two relatively moving surfaces in machine. Examples of such mixers include internal rotor/stator mixers in which the material is sheared between the rotor and the stator surfaces. Shear stressing can also be obtained by forcing a fluid material over one or more surfaces that do not have a motion relative to one another, for instance between the walls of a channel. In this case it is still possible to generate significant shear stresses in the fluid, but only at the expense of proving some form of pumping energy to propel the fluid over the surfaces. It has long been recognized however that an alternative mechanism, that of extensional flow, is capable of subjecting fluid materials to compressive and tensile stresses that in practice can be much higher than the sheer stresses.

Extensional flow requires that the fluid be pressurized in order to propel it between surfaces that subject the fluid to tensile or compressive stresses. Such surfaces can be generally orientated in the direction of the flow in which case the flowing material is accelerated or decelerated along its flow-path by virtue of mass conservation, or generally orientated across the direction of the flow, in which case the flowing material is decelerated and thus compressed by virtue of the change in the momentum of the fluid, such as in impact. Known mixers designed to operate on the basis of extensional flows for dispersion have thus required external means of pressurization in the form of high-pressure pumps located upstream (the same requirement for pumping applies to a mixer operating on the basis of shear flow between non-moving surfaces as mentioned above). Given that it is often a requirement that any given part of the material being mixed is subjected to a number of stressing cycles it is apparent that the overall pressures required to provide extensional flows and shear flows through a mixer can become prohibitively high. Additionally, the need to engineer such a mixer so as to ensure that the extensional flow and shear flow occur with maximum efficiency, i.e. the minimum pressure loss, is relatively costly.

It is an object of the present invention to provide an apparatus which obviates or mitigates the above disadvantages.

According to the present invention there is provided apparatus for mixing a material contained in a vessel, the apparatus comprising one or more flow channels and at least one pair of first and second members which are coaxially mounted one within the other about an axis of rotation such that facing surfaces of the first and second members curve around said axis defining a chamber therebetween, at least one or other of the first and second members having a non-circular curvature, the first and second members being rotatable relative to one another about said axis to thereby produce a pumping force to force material through said flow channels and chamber, wherein the radially outermost of said first and second members and a wall of the vessel move relatively to one another to stress and displace material present between the mixing apparatus and the wall of the vessel.

It is to be understood that the term "curvature" is not limited to a continually curving surface and thus each of the surfaces may have substantially linear portions.

Apparatus in accordance with the present invention provides that the radial spacing between the first and the second members changes about the axis of rotation as the two rotate relative to one another. An important aspect of the invention is that this effect is achieved with coaxially mounted-members. For instance, a similar effect is achieved by prior art mixers incorporating eccentrically mounted rotors and/or stators. The arrangement in accordance with the present invention is advantageous in that is dynamically more stable as it provides substantial pressure equalization and balance radially and circumferentially across the relatively rotatable members.

The relative movement between the mixing apparatus and the vessel (such as by rotation of the outermost one of said first and second relatively rotatable members) provides for a direct interaction between the mixing apparatus and the wall of the vessel so that a mixing action occurs between the vessel wall and the mixing apparatus. This mixing action may form a fundamental part of the overall mixing action, particularly where the size of the vessel is closely matched to the size of the mixing apparatus.

DESCRIPTION OF THE PREFERRED EMBODIMENTS

Figure 1:
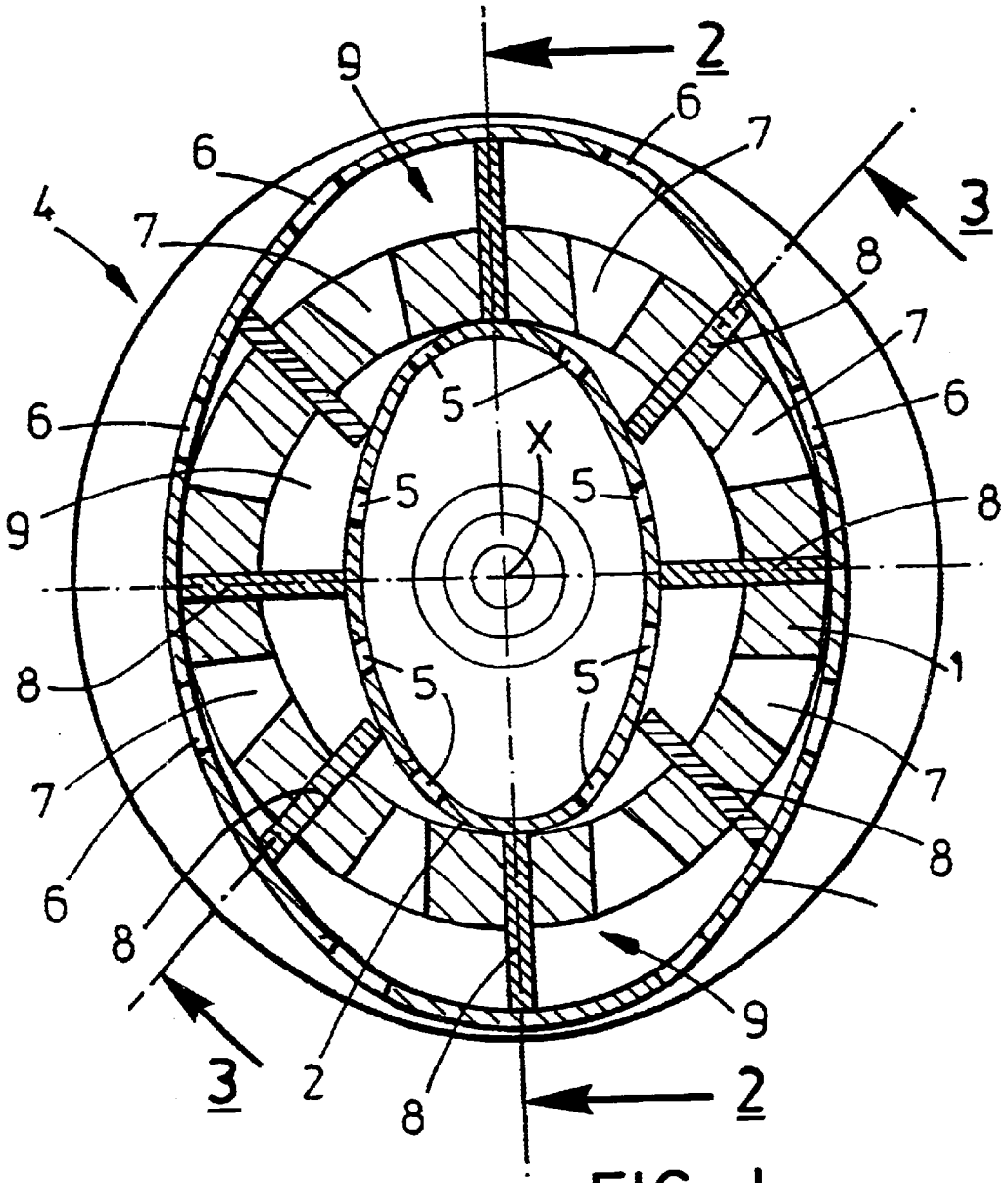
FIG. 1 is a schematic sectional end-view of an embodiment of a mixing head in accordance with the present invention.

Preferred embodiments of the invention comprise a mixing apparatus for immersion in a vessel containing a material to be mixed, and to be supported by mounting to the vessel, in such a way as to promote mixing operations occurring between the mixing apparatus and at least one wall of the vessel. For instance, the mixing apparatus may be in the form of a mixing head comprising said relatively rotatable first and second members, the outermost one of said first and second members defining the radially outermost portion of the mixing head, the mixing head being mounted on a shaft arrangement which both provides direct support for the mixing head and means for driving the rotation of the relatively rotatable members.

It will be appreciated that the vessel containing the material to be mixed need not have any particular form and could, for instance, be a tank holding a volume of said material or a pipe through which said material flows. Furthermore, the shape of the vessel need not necessarily match the shape of the mixing apparatus. For instance, it is envisaged that in the preferred embodiments of the invention the radially outermost one of said first and second relatively rotatable members will have a circular or cylindrical configuration but the vessel need not necessarily have a similar shape.

It is, however, preferred that the shape of the vessel is to some extent matched to the shape of the mixing apparatus, i.e. the outermost member of the mixing apparatus that moves relative to the vessel, so that forces generated by material being stressed between the mixing apparatus and the inner walls of the vessel are substantially balanced around said axis.

Embodiments of the invention may combine rotational interaction between the mixing apparatus and the vessel wall, with a degree of reciprocating or otherwise traversing movement along the axis of rotation to further optimize the mixing and pumping actions occurring. This may be particularly useful when mixing batches of material in which the blending and/or consistency of the various ingredients changes as the mixing progresses. The flow passages incorporated in mixing apparatus according to the present invention may be radially and/or axially orientated and the pumping/mixing actions may be radial and/or axial.

Apparatus in accordance with the present invention provides a mixer with integral pumping. This, for instance, may enable certain embodiments of the invention to pump material from the vessel either during or after a mixing operation. The relative efficiencies of the mixing and pumping operations may vary with different embodiments of the invention. For instance apparatus with a high mixing efficiency may have a relatively low pumping efficiency and vice versa.

Additional features of preferred embodiments of the apparatus in accordance with the present invention are detailed as follows and below. In one embodiment the mixing head of the apparatus includes a vessel with a substantially circular inner wall. The mixing head comprising at least one pair of first and second members at least one member is substantially circular and the second member is curved but non-circular. The members are coaxially mounted one inside of the other about an axis or rotation defining a chamber therebetween the two members. There are flow channels communicating with the chamber defined by the space between the members. The members are rotatable relative to one another and rotation relative to one another creates a pumping motion with respect to material within the chamber defined by the first and second members.

In another embodiment of the present invention, the apparatus comprises a mixing head have a non-circular rotor coaxially mounted about a stator. The rotor and stator are one inside of the other along an axis of rotation and define a chamber therebetween. There are flow channels communicating with the chamber defined by the space between the rotor and stator. The rotor is rotatable about the axis to produce a pumping action to force materials through said flow channels.

Apparatus in accordance with the present invention can be used to mix a single material (the term mixing in this context is used throughout the mixing industry referring to, for example, dispersive mixing of a material to break it down into smaller component parts which may be coupled with distributive mixing in distributing those smaller parts through the material as a whole) or a number of different materials including mixtures of fluids (liquids or gases) and solids, or indeed just solids which are capable of behaving in a manner analogous to fluids.

Embodiments of the present invention will now be described by way of example only, with references to the accompanying drawings.

Figure 2:
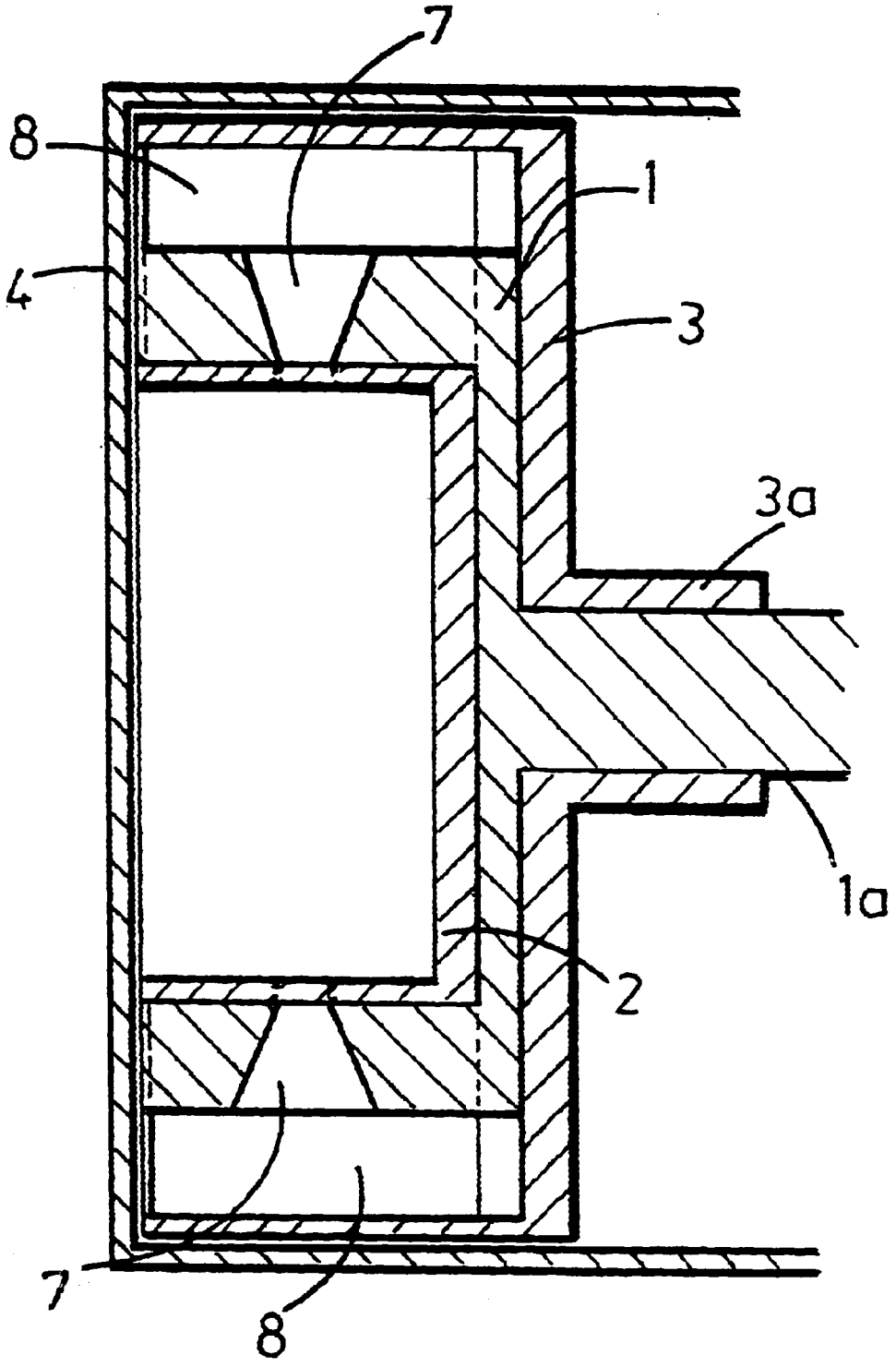
FIG. 2 is a part-section of the mixing head of FIG. 1 taken on the line 2—2.
Figure 3:
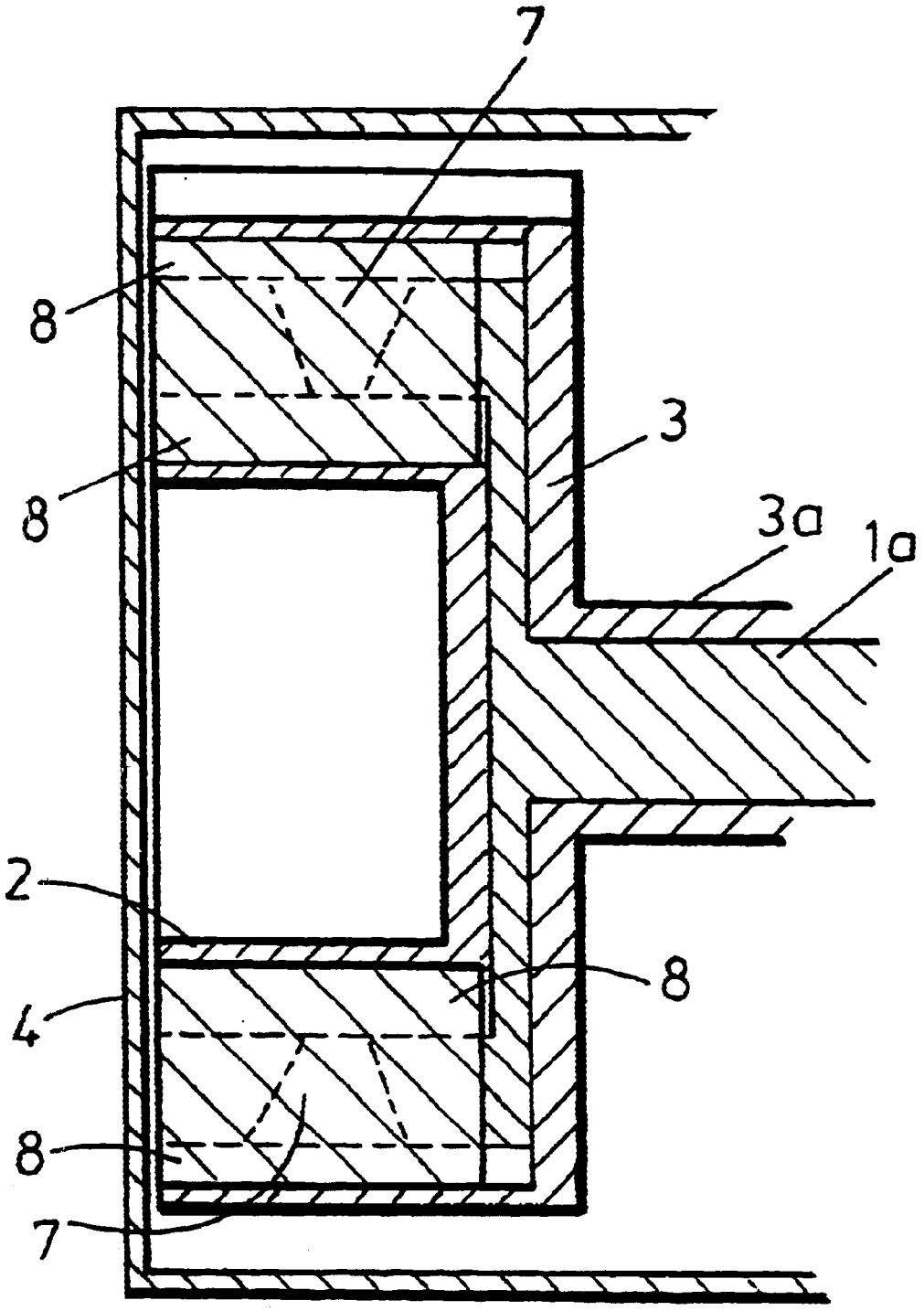
FIG. 3 is a part section of the mixing head of FIG. 1 taken on the line 3—3.

FIG. 1 is a schematic sectional end-view of an embodiment of a mixing head in accordance with the present invention;

FIG. 2 is a part section of the mixing head of FIG. 1 taken on the line A—A;

FIG. 3 is a part section of the mixing head of FIG. 1 taken on the line B—B.

Referring to FIGS. 2, and 3, the illustrated mixing head comprises a stator ring mounted between inner and outer rotor rings 2 and 3 within a generally cylindrical vessel which contains the material to be mixed 4. In FIGS. 2 and 3, the stator ring 1 and rotor rings 2 and 3 are mounted at the ends of respective shafts 1*a* and 3*a*, the rings 2 and 3 being fixed relative to one another and the shaft 3*a* being rotatable with respect to the shaft 1*a* about an axis X (any suitable drive means may be used and none is illustrated).

As best appreciated from FIG. 1, both the rotor rings 2 and 3 have an oval configuration and the radial spacing between their surfaces is substantially constant about the axis X. The stator ring 1, on the other hand, is circular and has an outer radius which corresponds with the minor axis of the outer rotor ring 3 and an inner radius which corresponds with the major axis of the inner rotor ring 2.

As depicted in FIG. 1, each of the rotor rings 2 and 3 and the stator ring 1 defines a set of radial channels 5, 6, and 7 respectively. In addition, the stator 1 carries a number of vanes 8 which extend between the oval rotor rings 2 and 3 which are capable of sliding radially with respect to the stator ring 1 and circumferentially with respect to the rotor rings 2 and 3 as shown in FIG. 1.

Referring to FIG. 1, the combination of the surfaces of the stator ring 1, the rotor rings 2 and 3, and the vanes 8, serve to enclose a set of inner and outer compartments 9 on either side of the stator ring 1 between the inner rotor ring 2 and outer rotor ring 3 respectively. Thus, two compartments 9 are defined between each pair of neighboring vanes 8, an inner compartment 9 between the stator ring 1 and the inner rotor 2, and an outer compartment 9 between the stator ring 1 and the outer rotor 3. The volume of each compartment 9 progressively increases and decreases as the rotors 2 and 3 rotate as a consequence of the difference in the curvature of the stator ring 1 (which is circular) and the rotor rings 2 and 3 (which are oval). A pumping action is therefore provided in which material is drawn into each compartment 9 as it expands and is expelled therefrom as the compartment contracts. The material enters and exits each compartment primarily through the channels 5, 6 and 7 that are radially disposed within the adjacent rings.

In operation, material to be mixed enters radially through the flow channels 6 in the outer rotor ring 3 into expanding outer compartments 9 defined between the outer rotor ring 3 and the stator ring 1. Shown in FIG. 1, rotation of the outer rotor ring 3 within the vessel 4 promotes flow between the outer wall 4 and the ring 3 towards the flow channels 6 and subjects the material between the rotor ring 3 and the vessel 4 to stresses so that interaction between the mixing head and the vessel 4 forms a fundamental part of the mixing action. At the same time, contracting outer compartments 9 defined between the outer rotor ring 3 and the stator ring 1 pump material radially through the stator ring flow channels 7 into inner compartments 9. In addition to the pumping action of the contracting outer compartment 9, material may also be drawn through the channels 7 as inner compartments 9 defined between the stator ring 1 and rotor ring 3 expand. Thus, material flows radially inwards through the stator ring 1 between each pair of outer and inner compartments 9 defined between respective pairs of vanes 8. Similarly, as inner compartments 9 defined between the stator ring 1 and the inner rotor ring 3 contract material is pumped through channels 5 defined in the inner rotor ring 3 to the axial outlet defined by the inner rotor ring 2. In this way, material is continually pumped through the mixing head simply by rotation of the rotors 2 and 3.

Although the net flow through the mixer is from the apertures 6 to the apertures 5, it will be appreciated that as each compartment 9 contracts there will be a pumping force both radially inward and outward and similarly as each compartment 9 expands it will draw in material from both radially outer and radially inner parts of the mixer. This is also beneficial in that it increases the residency time of material within the mixer enhancing mixing effects (more details of which are given below). The directional bias of the mixer is largely determined by the positioning and configuration of the channels, and in the illustrated embodiment particularly the tapered configuration of the channels 7 through the stator ring 1. The radially inward bias of the illustrated embodiment of the invention can, for instance, be enhanced by providing channels 6 through the outer rotor ring 3 only in regions corresponding to the expanding outer compartments 9, the ring 3 presenting a closed wall to the contracting compartments.

It is possible to reverse the bias of the mixer by, for instance, repositioning of the various channels and/or by redesign of the channels in the stator ring 1 (for instance tapering them in the opposite direction) so that material flows outwardly from the inner apertures 5 to the outer apertures 6. For instance, the number of channels 5 located in the outer rotor ring 3 could be increased in the region of contracting compartments 9 compared with expanding compartments 9 to favor radially outward flow. Similarly, the channels in contracting outer compartments 9 could be larger than those in expanding compartments to achieve the same effect. It will be appreciated that similar modifications could be made to the inner rotor ring 2.

As a further possible modification, instead of (or in addition to) the radial channels 5, 6 and 7, the device could be provided with axial channels communicating with axial apertures located at appropriate positions corresponding to the location of the various compartments 9.

Referring to FIGS. 2 and 3, it will be seen that the cross-section of the channels 7 in the stator ring 1 converge -in a radially inwards direction. This convergence imposes extension stresses and shear stresses on the material contained therein thereby subjecting the material to a combination of extension-dispersive and shear-dispersive mixing. The amount of stressing is related both to the geometry of each channel and also to the flow rates arising from the pressure differentials imposed across each channel and from the pumping geometry itself. The geometry of the channels can be selected to vary the degree of extensional and/or shear stressing. For instance, the channels could be configured so that extension stresses are effectively reduced to zero so that only shear-dispersive mixing occurs within those channels.

As shown in FIG. 1, in addition to the extensional-dispersive and shear-dispersive mixing provided by the channels 7. There is also distributive mixing as the nonmaterial passes between the rotor rings 2 and 3 and the stator ring 1. That is, each outer at compartment 9 receives material from each channel 6 of the outer rotor ring in sequence and thus each channel 7 in the stator ring receives material from each channel of the outer ring. Moreover, as material passing from each inner compartment 9 to the inner rotor 2 is distributed amongst each of the channels 5 of the inner rotor ring 2.

There will also be some degree of shear-dispersion occurring within the compartments 9 by virtue of rotation of the rotor rings relative to the stator ring and some extensional dispersive mixing as a result of the "tapering" geometry of the compartments 9.

Within the above described embodiment of the invention, the pumping mechanism is predominantly vane pumping. This is not, however, the only pumping mechanism that may be utilised in embodiments of the present invention and other forms of pumping such as for example positive displacement pumping, centrifugal pumping or dragflow pumping may be utilised. Indeed, with the embodiment described above (when configured to operate with radially outward flow) a certain amount of centrifugal pumping will occur in any event. The degree of centrifugal pumping will depend upon the design of the mixer and the material being mixed and could be relatively substantial in cases of low viscosity materials and high rotational speeds. The above described embodiment of the invention could, for example, readily be modified to provide centrifugal pumping only by removing the vanes 8. With such an embodiment, the material present in the chambers 9 would be subjected to rigorous shearing actions between the stator ring 1 and the rotor rings 2 and 3,and between outer rotor ring 3 and the wall of the receptacle 4, and also extensional flow due to the circumferential tapering of the chambers 9 and the spacing between the outer ring 3 and receptacle 4 (in addition to the stressing that occurs within the channels 5, 6 and 7). It will be appreciated that many modifications could be made to the particular mixer described above. For instance, the rotor rings 2 and 3 need not be ovaly shaped but could have any other suitable non-circular curvature. Alternatively, the rotor rings could be circular and the stator ring non-circular (e.g. oval). In addition, although preferable it is not essential that the radial spacing between the inner and outer rotors remains substantially constant around the axis. Similarly the stator need not be circular but could have any other appropriate curvature.

It will also be understood that the terms rotor and stator are relative terms, and that the above embodiment of the invention could for instance be modified by rotating the ring 1 within the rings 2 and 3 and rotating the vessel 4. Similarly, all three rings could be rotated, the inner and outer rings 2 and 3 being rotated at a different speed (and possibly even in a different direction) than the ring 1.

Although in the above description emphasis is placed very much upon the mixing mechanisms, it will be appreciated that the apparatus described is an integral mixer/pump. It will further be appreciated that embodiments of the invention can be designed to enhance one or other of these two functions. For instance, mixing can be enhanced by oscillating the mixing head within the material to be mixed so that the micro-dispersive and distributive mixing actions occurring within the head are combined with a macro-distribution within the material as a whole. Alternatively, embodiments of the invention can be designed to function primarily as a pump with any inherent mixing actions being purely secondary.

Embodiments of the invention could have more or less mixing/pumping stages than are present in the above described embodiment of the invention. For instance, the illustrated embodiment of the invention could be modified by dispensing with one or other of the inner and outer rotor rings 2 and 3. Alternatively, the embodiment could be modified by adding further rotor and/or stator rings to provide further mixing/pumping stages. It is a further aspect of the present invention that within any particular embodiment incorporating more than one mixing/pumping stage, each individual stage need not contain the same volume of material as any other stage. This can be particularly beneficial when seeking to add material into the material being mixed, or pumped, such as adding dilutant fluids into a particular stage of a mixing or pumping operation.

Many other possible alternative arrangements in accordance with the present invention will be readily apparent to the appropriately skilled person. For instance, it will be appreciated that the orientation of the mixing head and/or vessel need not be vertical but could be horizontal or any inclination between the two. The mixing apparatus in accordance with the present invention may have more than a single mixing head and could be combined within the vessel with any other form of mixing apparatus. The vessel within which the material is held, or through which the material flows, during the mixing operation could have a wide variety of different configurations and could be either open or closed.

Embodiments of the present invention may be used in a variety of applications in all areas of fluid mixing and fluid-solid mixing and across all industries where such mixing/pumping is required, such as for example, the chemical, food, healthcare, medical, petrochemical and polymer industries. The invention also has an application in areas of solids mixing where such solids can be considered to respond to the imposed forces in an essentially fluid-like manner, or where the solids are fragmented to the extent that, in the aggregate, they are capable of behaving in a manner analogous to fluids, or any combination of fluids and solids.

What is claimed is:

1. Apparatus for mixing a material, comprising a mixing head and a mixing vessel, the mixing head comprising at least one pair of first and second members which are coaxially mounted one within the other about an axis of rotation with the first member disposed within the second member such that facing surfaces of said first and said second members curve around said axis defining a chamber therebetween, and one or more flow channels communicating with said chamber, at least said second member having a non-circular curvature, said first and said second members being rotatable relative to one another about said axis to thereby produce a pumping force to force material through said one or more flow channels and said chamber, wherein the vessel has a substantially circular inner wall and said second member and said inner wall are rotatable relative to one another to stress and displace material present between said mixing head and the wall of the vessel.

2. Apparatus according to claim 1, wherein the curvature of said surface of said first member differs from the curvature of said surface of said second member about said axis.

3. Apparatus according to claim 1, wherein the curvature of said first member is circular.

4. Apparatus according to claim 1, comprising a plurality of said first and/or second members nested co-axially within each other, the outermost one of said first and second members being the member rotatable with respect to the wall of the vessel.

5. Apparatus according to claim 1, comprising; two of said second members having the same non-circular curvature, said second members defining a chamber therebetween within which at least one of said first members is located.

6. Apparatus according to claim 5, wherein both of said second members have said non-circular curvature and wherein the radial spacing between said second members is substantially constant about said axis.

7. A mixing apparatus according to claim 6, wherein said first member carries at least one vane which partitions said chamber defined between said second members, each said vane being mounted within said first member so as to be slidable in a radial direction.

8. Apparatus according to claim 7, wherein said first member carries a plurality of said vanes which partition said chamber between said second members into a plurality of compartments, the volume of each said compartment changes as said first member rotates relative to said second members.

9. Apparatus according to claim 5, wherein said first member has a circular curvature.

10. Apparatus according to claim 1, wherein at least one of said one or more flow channels communicates directly with said chamber defined between any pair of concentric members.

11. A mixing apparatus according to claim 1, wherein at least one of said one or more flow channels is defined by one of said first or one of said second members.

12. Apparatus according to claim 11, wherein the or each said first member and/or the or each said second member defines at least one of said one or more flow channels extending generally radially therethrough.

13. Apparatus according to claim 1, wherein at least one of said one or more flow channels extends generally parallel to said axis.

14. Apparatus according to claim 1, comprising one or more axial and/or radial inlet and outlet passages or apertures, wherein said pumping force produces a net flow of material from the or each inlet passage/aperture to the or each outlet passage/aperture via said one or more flow channels and said chamber.

15. Apparatus according to claim 1, wherein at least one of the or each pairs of first and second members oscillate along said axis.

16. Apparatus for mixing a material contained in a vessel, the apparatus comprising at least one pair of first and second members coaxially mounted one within the other about an axis of rotation such that facing surfaces of said first and second members curve around said axis defining a chamber therebetween, one or more flow channels communicating with said chamber, at least one or the other of said first and second members of each pair having a non-circular curvature, said first and second members being rotatable relative to one another about said axis to thereby produce a pumping force to force material through said one or more flow channels and said chamber, the radially outermost of said first and second members being rotatable relative to a wall of the vessel to stress and displace material present therebetween, wherein at least one of said first members is mounted between two of said second members, said second members defining a chamber therebetween within which said first member is located, wherein said first member has a non-circular curvature and said second members have a circular curvature.

* * * * *